US008803408B2

(12) United States Patent
Ikeda et al.

(10) Patent No.: US 8,803,408 B2
(45) Date of Patent: Aug. 12, 2014

(54) LIGHT SOURCE DEVICE

(75) Inventors: Tomohiko Ikeda, Hyogo (JP); Hiroshi Takahashi, Hyogo (JP); Shinichi Ushijima, Himeji (JP); Tetsuya Gouda, Hyogo (JP)

(73) Assignee: Phoenix Electric Co., Ltd., Hyogo (JP)

( * ) Notice: Subject to any disclaimer, the term of this patent is extended or adjusted under 35 U.S.C. 154(b) by 0 days.

(21) Appl. No.: 13/809,660

(22) PCT Filed: Aug. 16, 2012

(86) PCT No.: PCT/JP2012/005173
§ 371 (c)(1),
(2), (4) Date: May 22, 2013

(87) PCT Pub. No.: WO2013/088596
PCT Pub. Date: Jun. 20, 2013

(65) Prior Publication Data

US 2013/0229101 A1 Sep. 5, 2013

(30) Foreign Application Priority Data

Dec. 16, 2011 (JP) ..... 2011-276441

(51) Int. Cl.
*H01J 61/54* (2006.01)

(52) U.S. Cl.
CPC ..... *H01J 61/54* (2013.01)
USPC ..... 313/5

(58) Field of Classification Search
USPC ..... 313/5, 495–500
See application file for complete search history.

(56) References Cited

U.S. PATENT DOCUMENTS

| | | | |
|---|---|---|---|
| 6,380,679 | B1 | 4/2002 | Leers et al. |
| 2004/0095069 | A1 | 5/2004 | Yamashita et al. |
| 2007/0242459 | A1 | 10/2007 | Nishigaki |
| 2009/0121602 | A1 | 5/2009 | Miwata et al. |
| 2009/0224667 | A1 | 9/2009 | Fujii et al. |

FOREIGN PATENT DOCUMENTS

| | | |
|---|---|---|
| JP | 2000-047327 | 2/2000 |
| JP | 2004-139955 | 5/2004 |
| JP | 2010-251179 | 4/2010 |

*Primary Examiner* — Anh Mai
*Assistant Examiner* — Brenitra M Lee
(74) *Attorney, Agent, or Firm* — Lucas & Mercanti, LLP

(57) ABSTRACT

[Object] To provide a light source device which allows the lighting starting properties of a high-pressure discharge lamp to be reliably improved without increasing the entire length of the light source device and exposing an auxiliary lamp to the outside.

[Solution] A light source device 10 includes: a high-pressure discharge lamp 12; a bowl-shaped reflector 16 having an insertion hole 44 which is formed in a bottom portion 16*a* and in which a sealing portion 24 is inserted, an inner space 46, and a reflection surface 48 formed on an inner surface thereof; an auxiliary lamp 14 which emits ultraviolet rays UV; and a base 18 having formed therein an accommodation space 52 in which the auxiliary lamp 14 is accommodated between the base 18 and the outer side of the bottom portion 16*a*. The object can be achieved by setting a thickness t of the bottom portion 16*a* to be small such that an outer end portion 24*a* of the sealing portion 24 inserted in the insertion hole 44 projects into the accommodation space 52 of the base 18 and such that the entirety of an ultraviolet ray emitting space 36 of the auxiliary lamp 14 located along the side surface of the sealing portion 24 faces the sealing portion 24 in the accommodation space 52.

2 Claims, 4 Drawing Sheets

LIGHT SOURCE DEVICE

CROSS REFERENCE TO RELATED APPLICATION

This Application is a 371 of PCT/JP2012/005173 filed on Aug. 16, 2012 which, in turn, claimed the priority of Japanese Patent Application No 2011-276441 filed on Dec. 16, 2011, both applications are incorporated by reference herein.

TECHNICAL FIELD

The present invention relates to a light source device that includes a high-pressure discharge lamp and an auxiliary lamp that emits ultraviolet rays for reducing the voltage required to start lighting of the high-pressure discharge lamp and thus improving the starting characteristics.

BACKGROUND ART

High-pressure discharge lamps that can provide a large amount of light are mainly used for light source devices used in optical apparatuses such as liquid crystal projectors and exposure apparatuses. Such a high-pressure discharge lamp includes: a light-emitting portion having a space in which a light-emitting material or a halogen-cycle product, such as mercury and a halogenated product, is enclosed; and a pair of main electrodes arranged in the light-emitting portion so as to be opposed to each other. At the time of start of lighting, a high voltage is applied, discharge is caused by dielectric breakdown between the main electrodes, and thereby the light-emitting material is excited to emit light.

In recent years, in order to cause a high-pressure discharge lamp to function as a point light source on the one hand and to enhance the light-emitting efficiency on the other hand, the amount of a light-emitting material enclosed has been increased, while the volume of the internal space of the light-emitting portion has been reduced. Accordingly, the internal pressure of the light-emitting portion during lighting becomes significantly high. The internal pressure in some recent examples is reported to be around 200 atm or more. Furthermore, in the above type of optical apparatuses, it is demanded to reduce time taken for relighting (hot start), as well as time taken for initial lighting (cold start).

Generally, the higher the internal pressure of a light-emitting portion is, the higher the voltage required to start discharge is. Therefore, in order to relight a high-pressure discharge lamp while the internal temperature of its light-emitting portion is high (hot start), it is necessary not only to apply a high voltage but also to wait until the temperature of the high-pressure discharge lamp is decreased to a certain degree. In addition, a high voltage (e.g., 10 kV or more) needs to be applied even for initial lighting (cold start).

However, applying a high voltage to start lighting of a high-pressure discharge lamp is accompanied with some problems. For example, dielectric breakdown may occur not only between the main electrodes but also in unintended parts (e.g., dielectric breakdown of a dielectric cable coating, and creeping discharge in a connector or a connection terminal), leading to electric shock, or an electric circuit provided in the optical apparatus may be erroneously operated by noise at the time of application of a high voltage.

In response, techniques for starting lighting of a high-pressure discharge lamp by a lower voltage have been developed (see Patent Literature 1, for example). As shown in FIG. 5, a light source device 1 of Patent Literature 1 is composed of a high-pressure discharge lamp 2, an auxiliary lamp 3 formed separately from the high-pressure discharge lamp 2, a reflector 4, and a base B.

The high-pressure discharge lamp 2 is composed of a light emitting tube 5 which includes a light-emitting portion 5*a* having an internal space in which a light-emitting material M1 such as mercury is enclosed, and sealing portions 5*b* which seal the internal space of the light-emitting portion 5*a*; and power feeding means 6 which includes: a pair of main electrodes 6*a* arranged in the light-emitting portion 5*a* so as to be opposed to each other; a pair of metal foils 6*b* electrically connected to the main electrodes 6*a*, respectively, and embedded in the sealing portions 5*b*, respectively; and a pair of external lead rods 6*c*, one ends of which are electrically connected to the metal foils 6*b*, respectively, and embedded in the sealing portions 5*b*, respectively, and the other ends of which project outward from the light emitting tube 5.

The auxiliary lamp 3 is composed of a cylindrical discharge container 7 having a discharge space 7*a* in which a material that generates ultraviolet rays UV1 and UV 2 when excited by discharge is enclosed as a discharging medium M2; and a pair of external electrodes 9*a*, 9*b* wound around the respective outer peripheral surfaces of both end portions of the discharge container 7.

The reflector 4 is composed of a main body portion 4*a* on which a concave reflection surface 4*c* is formed, and a sealing portion attachment portion 4*b* projecting rearward from the bottom portion of the main body portion 4*a*. A first insertion hole X, in which one of the sealing portions 5*b* of the high pressure discharge lamp 2 is inserted, is formed from the sealing portion attachment portion 4*b* to the bottom portion 4*d*. In addition, a second insertion hole Y, in which the same sealing portion 5*b* is inserted and fixed with an adhesive, is formed in the base B. Furthermore, a recess Z is formed on the base B, and thus a space A is created between the bottom portion of the reflector 4 and the inner surface of the recess Z when the base B is attached over the bottom portion of the reflector 4 from the outside.

The light source device 1 is produced in the following steps one of the sealing portions 5*b* of the high-pressure discharge lamp 2 is inserted into the first insertion hole X of the reflector 4; the discharge container 7 of the auxiliary lamp 3 is then provided near the peripheral surface of the sealing portion 5*b* projecting from the first insertion hole X along the direction perpendicular to the longitudinal direction of the seating portion 5*b*; the sealing portion 5*b* is subsequently inserted into the second insertion hole Y and the base B is attached over the bottom portion of the reflector 4; and the second insertion hole Y is filled with an adhesive to finally fix the high-pressure discharge lamp 2 to the base B. The reason why the auxiliary lamp 3 has to be provided as described above along the direction perpendicular to the longitudinal direction of the sealing portion 5*b* is that since the entire length of the light source device 1 is defined and the auxiliary lamp 3 needs to have a certain length, the auxiliary lamp 3 cannot be fully accommodated in the recess Z even if it is attempted to locate the auxiliary lamp 3 along the sealing portion 5*b*.

When starting lighting of the high-pressure discharge lamp 2 having the above structure, a high-frequency voltage is applied between the external electrodes 9*a*, 9*b* of the auxiliary lamp 3. Thus, discharge is caused between the external electrodes 9*a*, 9*b* via the discharge space 7*a* of the discharge container 7, and the discharging medium M2 in the discharge space 7*a* is excited by the discharge and generates ultraviolet rays. The ultraviolet rays pass through routes UV1 and UV2 and then reach the light-emitting portion 5*a*.

The ultraviolet rays having passed through the routes UV1 and UV2 strike the main electrodes 6*a* in the light-emitting portion 5*a* of the high-pressure discharge lamp 2, thereby promoting the discharge between the main electrodes 6*a*.

CITATION LIST

Patent Literature

Patent Literature 1: Japanese Laid-Open Patent Publication No. 2004-139955 (FIG. 7, FIG. 8)

SUMMARY OF THE INVENTION

Problems to be Solved by the Invention

However, the light source device 1 of Patent Literature 1 has the following problem. That is, in the light source device 1, most of the ultraviolet rays emitted from the auxiliary lamp 3 enter the sealing portion 5*b* which is the route UV1, then pass through the inside of the sealing portion 5*b* while being internally reflected, enter the internal space of the light-emitting portion 5*a*, and strike the main electrodes 6*a*. A small amount of the remaining ultraviolet rays pass between the inner surface of the first insertion hole X formed in the reflector 4 and the outer surface of the sealing portion 5*b* (route UV2), then enter the light-emitting portion 5*a* from the outside, and strike the main electrodes 6*a*. In the route UV2, since the ultraviolet rays diverge without striking the light-emitting portion 5*a* in some cases, the efficiency of irradiation via this route is not high. Accordingly, the ultraviolet rays that pass through the route UV1 contribute to the effect of promoting the discharge between the main electrodes 6*a*.

However, since the reflector 4 of the light source device 1 has the sealing portion attachment portion 4*b* projecting rearward from the bottom portion 4*d* of the main body portion 4*a*, the distance from the bottom of the concave reflection surface 4*c* to the end surface of the sealing portion attachment portion 4*b* is long. In the light source device 1 whose entire length is defined, therefore, the length of the base B has to be inevitably short. Consequently, as described above, the recess Z cannot be made deep. This means that the distance from the auxiliary lamp 3 to the light-emitting portion 5*a* of the high-pressure discharge lamp 2 inevitably becomes long, leading to reduction in the effect of improving the lighting starting properties of the high-pressure discharge lamp 2 via the route UV1.

Additionally, since the discharge container 7 of the auxiliary lamp 3 is provided along the direction perpendicular to the longitudinal direction of the sealing portion 5*b*, both end portions 7*b* of the discharge space 7*a* in the auxiliary lamp 3 cannot be positioned in front of the sealing portion 5*b*. Accordingly, most of the ultraviolet rays emitted from the end portions 7*b* cannot enter the sealing portion 5*b* which is the route UV1, and thus the main electrodes 6*a* cannot be efficiently irradiated. This is also a factor for reduction in the effect of improving the lighting starting properties of the high-pressure discharge lamp 2.

In an attempt to at least solve the latter problem, for example, it is conceivable to provide the auxiliary lamp 3 along the sealing portion 5*b* of the high-pressure discharge lamp 2 as shown in FIG. 6. However, since the entire length of the light source device 1 is defined and the entire length of the base B is thus limited to be short as described above, the auxiliary lamp 3 partially protrudes from the base B, and ultraviolet rays emitted from the protruding end portion 7*c* of the discharge space 7*a* are not utilized. Consequently, the effect of improving the lighting starting properties is reduced.

In addition, since the above-described route UV1 is lengthened, contribution to the effect of promoting the discharge between the main electrodes 6*a* is also suppressed.

Alternatively, as shown in FIG. 7, it is also conceivable to shift the position of the auxiliary lamp 3 toward the light-emitting portion 5*a* of the high-pressure discharge lamp 2 such that the entire discharge space 7*a* in the auxiliary lamp 3 faces the sealing portion 5*b*. In this case, however, the first insertion hole X of the reflector 4 has to be expanded as shown in FIG. 7(*b*) (a dotted portion in FIG. 7(*b*) is expanded) so that the auxiliary lamp 3 can also be inserted in the first insertion hole X. This deteriorates productivity and thereby increases cost. Furthermore, since the area of the reflection surface near the first insertion hole X, which is the most important for the reflection performance of the reflector 4, is reduced, there is a possibility that the amount of light emitted from the light source device 1 is reduced.

The present, invention has been made in view of the above problems of the conventional techniques. Therefore, a main object of the present invention is to provide a light source device which allows the lighting starting properties of a high-pressure discharge lamp to be reliably improved by an auxiliary lamp without increasing the entire length of the light source device and without exposing the auxiliary lamp to the outside.

Solution to the Problems

In order to attain the above object, for example, a light-emitting device 10 of the present, invention has the following features as shown in FIG. 1.

The light-emitting device 10 includes:

a high-pressure discharge lamp 12 having: a light-emitting portion 22 having therein a pair of main electrodes 28 opposed to each other; and sealing portions 24 extending outward from the light-emitting portion 22;

a bowl-shaped reflector 16 having: an insertion hole 44 which is formed in a bottom portion 18*a* and in which one of the sealing portions 24 and a current-carrying wire for an auxiliary lamp can be inserted; an inner space 46 in which the high-pressure discharge lamp 12 is accommodated with the one sealing portion 24 inserted in the insertion hole 44; and a reflection surface 48 which is formed on an inner surface of the reflector 16 and which reflects light from the high-pressure discharge lamp 12;

an auxiliary lamp 14 having an ultraviolet ray emitting space 36 in which ultraviolet rays UV are generated;

a current-carrying wire 64 which is connected to an external lead rod 32 protruding from the other sealing portion 24 opposite to the sealing portion 24 inserted in the insertion hole 44, which is inserted in the insertion hole 44, and which is wound around an outer surface of a discharge container 38 of the auxiliary lamp 14 to form an external electrode 42; and a base 18 attached over an outer surface of the bottom portion 16*a* of the reflector 16 and having an accommodation space 52 in which the auxiliary lamp 14 is accommodated, wherein a thickness t of the bottom portion 16*a* of the reflector 16 in which the insertion hole 44 is formed is set to be small such that an outer end portion 24*a* of the sealing portion 24 inserted in the insertion hole 44 projects through the insertion hole 44 into the accommodation space 52 of the base 18, and such that the entire ultraviolet ray emitting space 36 of the auxiliary lamp 14 located along a side surface of the sealing portion 24 faces the sealing portion 24 and is accommodated in the accommodation space 52.

As described above, the thickness t of the bottom portion 16*a* of the reflector 16 in which the insertion hole 44 is formed is set to be small such that the entire ultraviolet ray emitting space 36 of the auxiliary lamp 14 located along the side surface of the sealing portion 24 projecting through the insertion hole 44 of the reflector 16 into the accommodation space 52 of the base 18 faces the sealing portion 24 and is accommodated in the accommodation space 52. In other words, the reflector 16 is formed by metal molding so as to have a bowl shape identical or similar to that obtained by cutting away the sealing portion attachment portion 4*b* from the conventional reflector 4, has no sealing portion attachment portion 4*b*, and is thinner by the thickness of the sealing portion attachment portion 4*b*. Accordingly, the distance from the auxiliary lamp 14 to the light-emitting portion 22 of the high-pressure discharge lamp 12 can be shortened, and the auxiliary lamp 14 can be prevented from being exposed to the outside without increasing the entire length of the light source device 10. In addition, since the entire ultraviolet ray emitting space 36 faces the sealing portion 24, it is possible to minimize the amount of the ultraviolet rays UV that do not strike the main electrodes 28, thereby maintaining the effect of improving the lighting starting properties. In the reflector 16 which is formed by metal molding so as to have a bowl shape identical or similar to that obtained by cutting away the sealing portion attachment portion 4*b* which is cylindrical or hollow circular truncated cone-shaped, the entire outer peripheral surface is formed into a substantially convex arc shape, and the rear end surface is formed flat.

The expression "the entire ultraviolet ray emitting space 36 faces the sealing portion 24" means that, as shown in FIG. 2(*a*), the entirety of the ultraviolet ray emitting space 36 is located in front of the entire periphery of the sealing portion 24 (an area R in FIG. 2(*a*)). Accordingly, even when, for example, a central axis C1 of the ultraviolet ray emitting space 36 and a central axis C2 of the sealing portico 24 are not parallel to each other (see FIG. 2(*b*), (*c*)) because of error in the assembly process, if the entirety of the ultraviolet ray emitting space 36 is contained in the area R, it can be said that "the entire ultraviolet ray emitting space 36 faces the sealing portion 24". However, it should be understood that the expression does not include the case where the central axis C1 makes a large angle, for example, a right angle, with the central axis 2. The same applies to the whole of the present specification.

The present invention preferably includes the following feature.

That is, there is preferably a first gap 68 between an inner surface of the insertion hole 44 of the reflector 16 and an outer surface of the sealing portion 24 inserted in the insertion hole 44.

Due to this feature, part of the ultraviolet rays UV emitted from the auxiliary lamp 14 enter the light-emitting portion 22 of the high-pressure discharge lamp 12 through the first gap 68, and strike the main electrodes 28. Accordingly, the ultraviolet rays UV for improving the lighting starting properties of the high-pressure discharge lamp 12 strike the main electrodes 28 in the light-emitting portion 22 not only via a route passing through the sealing portion 24 of the high-pressure discharge lamp 12 but also via a route entering the light-emitting portion 22 from the outside. Since the amount of the ultraviolet rays UV striking the main electrodes 28 is thus increased, even if the thickness t of the bottom portion 16*a* of the reflector 16 is slightly increased, predetermined lighting starting properties can be obtained.

Preferably, the present invention further includes the following feature.

The base 18 is a bowl-shaped member including a main body portion 73 in which the accommodation space 52 is formed and which is attached to a surface of the bottom portion 16*a* of the reflector 16, and a cover portion 74 which extends from the main body portion 73 so as to cover the bottom portion 16*a* of the reflector 16 with a second gap 88 from an outer surface 90 of the reflector 16 and whose front end portion 76 is attached to the outer surface 90, and when the base 18 is attached to the bottom portion 16*a* of the reflector 16, a center of the light-emitting portion 22 of the high-pressure discharge lamp 12 accommodated in the reflector 16 is positioned on an opening face 86, of the base 18, which is defined by a periphery of the second gap 88 on the front end portion 76 side, or is positioned inwardly from the opening face 86.

When the light-emitting portion 22 is burst for some reason (e.g., aged deterioration and overcurrent), the part of the reflector 16 on the bottom portion 16*a* side with respect to the center of the light-emitting portion 22 of the high-pressure discharge lamp 12 is likely to be subject to impact by the burst. If the center of the light-emitting portion 22 of the high-pressure discharge lamp 12 is positioned on the opening lace 86 defined by the periphery, on the front end portion 76 side, of the second gap 88 between the cover portion 74 and the outer surface 90 of the reflector 16, or is positioned inwardly from the opening face 86, the cover portion 74 of the base 18 is extended over the "impact-susceptible part" of the reflector 16 between the front end portion 76 described above and the part at which the main body portion 73 of the base 18 is attached to the reflector 16. As a result, the second gap 88 can act as a buffer for absorbing a mechanical impact caused by breakage of the light-emitting portion 22.

Due to this feature, even if the light-emitting portion 22 is burst and the reflector 16 is cracked, since the second gap 88 absorbs an impact acting on the "impact-susceptible part" of the reflector 16, breakage of the reflector 16 can be avoided.

Advantageous Effects of the Invention

The present invention can provide a light source device for which a predetermined effect of improving the lighting starting properties can be obtained without increasing the entire length of the light source device and without exposing an auxiliary lamp to the outside.

DESCRIPTION OF EMBODIMENTS

Hereinafter, embodiments of a light source device 10 to which the present invention is applied will be described with reference to the drawings. A first embodiment will be described first, and then second and third embodiments will be described. In the second and third embodiments, the differences from the first embodiment will mainly be discussed, and the descriptions in the first embodiment will be employed for the other common matures.

First Embodiment

Figure 1:
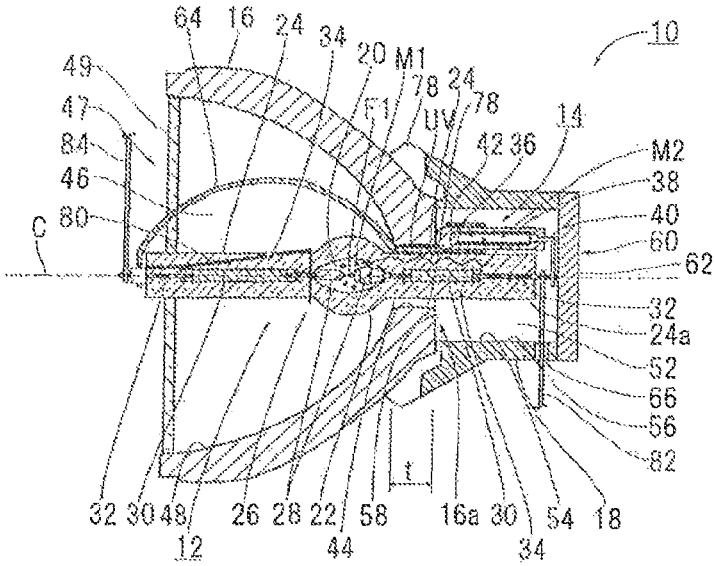
FIG. 1 is a cross-sectional view showing a light source device to which the present invention is applied.

As shown in FIG. 1, the light source device 10 of the present embodiment is generally composed of a high-pressure discharge lamp 12, an auxiliary lamp 14 formed separately from the high-pressure discharge lamp 12, a reflector 16, end a base 18.

The high-pressure discharge lamp 12 includes: a light-emitting tube 26 which has a light-emitting portion 22 having an internal space 20 in which a light-emitting material M1 such as mercury is enclosed, and a pair of sealing portions 24 which seal the internal space 20 of the light-emitting portion 22; and power feeding means 34 which includes: a pair of main electrodes 28 arranged in the light-emitting portion 22 so as to be opposed to each other; a pair of metal foils 30 electrically connected to the main electrodes 28, respectively, and embedded in the sealing portions 24, respectively; and a pair of external lead rods 32, one ends of which are electrically connected to the metal foils 30, respectively, and embedded in the sealing portions 24, respectively, and the other ends of which project outward from the light-emitting tube 26.

A trigger wire 80 may be attached to the high-pressure discharge lamp 12 as necessary. In the present embodiment, the trigger wire 80 is wound around a joint part between the light-emitting portion 22 and the sealing portion 24 located on the cathode side in the high-pressure discharge lamp 12. However, the trigger wire 80 may additionally be wound around a joint part between the light-emitting portion 22 and the sealing portion 24 located on the anode side.

In the present embodiment, a high-pressure discharge lamp for DC in which the anode is formed so as to be larger than the cathode is used. However, a high-pressure discharge lamp for AC in which the cathode and the anode have the same size may be used.

The auxiliary lamp 14 includes: a cylindrical discharge container 38 having an ultraviolet ray emitting space 36 in which a material that generates ultraviolet rays UV when excited by discharge is enclosed as a discharging medium M2; an internal electrode 40, one end of which is located in the ultraviolet ray generation space 36 and the other end of which extends to the outside; and an external electrode 42 wound around a part of the outer periphery of the discharge container 38 that corresponds to the ultraviolet ray generation space 36.

The form of the auxiliary lamp 14 is not limited to that shown in the embodiment. An auxiliary lamp which has been described as a conventional product and in which a pair of electrode wires is wound around the outer periphery of the discharge container 38, an auxiliary lamp in which only one of the internal electrode and the external electrode is used and discharge is caused between the internal electrode or the external electrode and the metal foil 30 embedded in the sealing portion 24, or the like, may be used.

The reflector 16 is a bowl-shaped member that has: an insertion hole 44 which is formed in a bottom portion 16*a* and in which the sealing portion 24 of the high-pressure discharge lamp 12 is inserted; an inner space 46 in which the high-pressure discharge lamp 12 is accommodated with the sealing portion 24 inserted in the insertion hole 44; a light sending-out opening 47 through which light from the accommodated high-pressure discharge lamp 12 is sent out; and a reflection surface 48 which is formed on an inner surface of the reflector 16 and which reflects light from the high-pressure discharge lamp 12. In addition, a front, cover 49 made of a translucent material is attached to the light sending-out opening 47 as necessary.

In particular, in the present embodiment, a thickness t of the bottom portion 16*a* of the reflector 16, in which the insertion hole 44 is formed, is set to be small such that an outer end portion 24*a* of the sealing portion 24 of the high-pressure discharge lamp 12 which is inserted in the insertion hole 44 projects through the insertion hole 44 into an accommodation space 52 of the base 18 described later, and such that the entire ultraviolet ray emitting space 36 of the auxiliary lamp 14 located along the side surface of the projecting sealing portion 24 faces the sealing portion 24 and is accommodated in the accommodation space 52.

In other words, the reflector 16 has a shape identical or similar to that obtained by cutting away 1.5 mm to 5 or 5.5 mm of the sealing portion attachment portion 4*b*, which is cylindrical or hollow circular truncated cone-shaped, from the conventional reflector 4. The reflector 16 is formed by metal molding, has no sealing portion attachment portion 4*b*, has a bowl-shaped appearance in which the entire outer peripheral surface is formed into a substantially convex arc shape and the rear end surface is formed flat, and is thinner by the thickness of the sealing portion attachment portion 4*b*. More specifically, in the conventional reflector 4, the sealing portion attachment portion 4*b* has a cylindrical shape or a hollow circular truncated cone shape in which the first insertion hole X is bored along the central axis and which tapers toward the rear end surface, while the reflector main body 4*a* has a bowl shape. The reflector main body 4*a* and the sealing portion attachment portion 4*b* are connected at their border by a gentle curve, and the cylindrical or circular truncated cone-shaped part corresponds to the sealing portion attachment portion 4*b*. The reflector 16 of the present invention is formed by metal molding so as to have a shape identical or similar to that obtained by cutting away the cylindrical or circular truncated cone-shaped sealing portion attachment portion 4*b* at the border, where the curvature changes, between a curved surface forming the outer peripheral surface of the reflector main body 4*a* and the outer surface of the sealing portion attachment portion 4*b*. The entire outer peripheral surface of the reflector 16 is formed so as to have a substantially convex arc shape in longitudinal cross section, and the rear end surface is formed flat.

Conceivable examples of the material for the reflector 16 include glass and aluminum. When the material is aluminum, the reflection surface 48 is metal-evaporated. When the material is glass, the reflection surface 48 that is not only metal-evaporated but also coated with an infrared-transparent film is formed on the inner surface of the reflector 16.

The reflection surface 48 is defined by a paraboloid of revolution whose central axis is a central axis C, and a focal point F1 of the paraboloid of revolution is positioned on the central axis C inside the reflector 16. The shape of the reflection surface 48 is optimally designed based on the characteristics, such as shape and size, of the high-pressure discharge lamp 12 such that the focal point F1 is positioned at the center of the light-emitting portion 22 of the high-pressure discharge lamp 12 accommodated inside the reflector 16. The shape of the reflection surface 48 is not limited to a paraboloid of revolution, and may be an ellipsoid of revolution whose central axis is the central axis C, or may be any shape as long as light distribution appropriate for a target to be irradiated by the light source device 10 or for the purpose of irradiation can be achieved.

Figure 2:
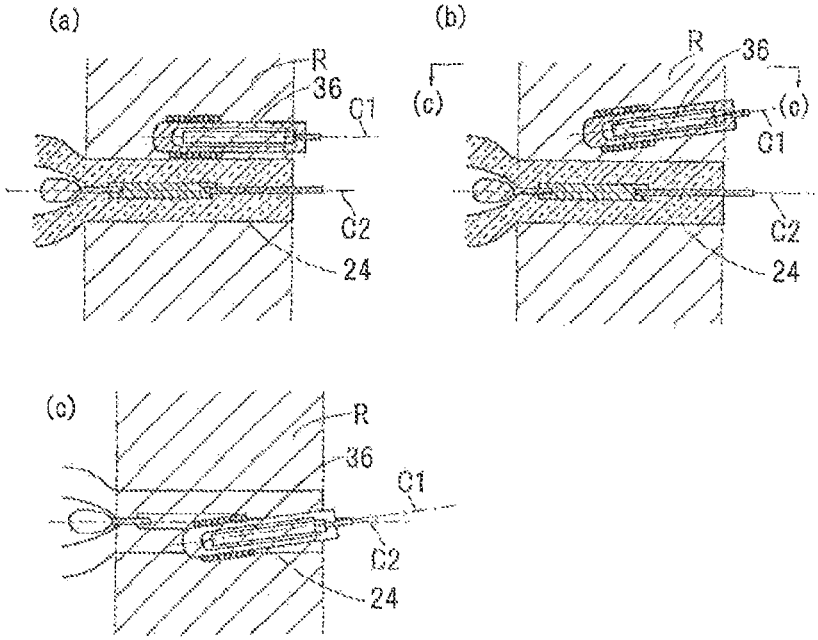
FIGS. 2(*a*) and (*b*) are cross-sectional views each showing a state where the entirety of an ultraviolet ray emitting space of an auxiliary lamp faces a sealing portion, and FIG. 2(*c*) is a view of the state as seen along an arrow C-C in FIG. 2(*b*).

The expression "the entire ultraviolet ray emitting space 36 faces the sealing portion 24" means that, as shown in FIG. 2(*a*), the entirety of the ultraviolet ray emitting space 36 is located in front of the entire periphery of the sealing portion 24 (an area R in FIG. 2(*a*)). Accordingly, even when, for example, the central axis C1 of the ultraviolet ray emitting space 36 and a central axis C2 of the sealing portion 24 are not parallel to each other (see FIG. 2(*b*), (*c*)) because of error in the assembly process, if the entirety of the ultraviolet ray emitting space 36 is contained in the area R, it can be said that "the entire ultraviolet ray emitting space 36 faces the sealing portion 24". The same applies to the whole of the present specification.

The base 18 is a member that is attached over the outside of the bottom portion 16*a* of the reflector 16 and that has the accommodation space 52 for accommodating the auxiliary lamp 14. The base 18 is preferably made of a material having high insulation properties and high thermal conductivity, such as ceramic. Additionally, a current-carrying wire insertion hole 66 for connecting the accommodation space 52 to the outside is formed in the peripheral surface of the base 18.

In the present embodiment, the accommodation space 52 of the base 18 is formed as an accommodation recess 54 which is open toward the bottom portion 16*a* of the reflector 16. The accommodation recess 54 is formed by providing a through hole 56 in the base 18*a* and attaching a cover 62 which covers an opening 60 of the through hole 56 opposite to an opening 58 attached to the bottom portion 16*a* of the reflector 16. The attachment of the cover 62 is not essential, and the inside of the through hole 56 without the cover 62 may be the accommodation space 52. In addition, in the case where the cover 62 is not used, there is a possibility that the ultraviolet rays UV from the auxiliary lamp 14 leak to the outside from the opposite opening 60 described above. In this case, therefore, it is preferable to at least cover an end portion of the auxiliary lamp 14 on the opening 66 side (excluding a part corresponding to the ultraviolet ray emitting space 36) and an end portion of the sealing portion 24 on the opening 60 side, by using an insulating adhesive or the like. Needless to say, this also serves to prevent the situation where the external lead rod 32 or the like to which a high voltage is applied is accidentally touched through the opening 60.

Figure 3:
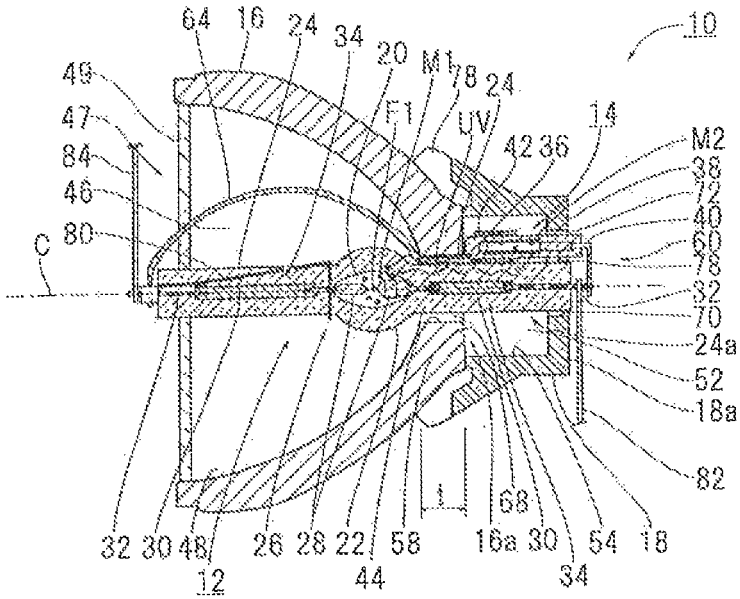
FIG. 3 is a cross-sectional view showing a light source device according to another embodiment.

It should be understood that the form of the accommodation recess 54 is not limited to the above one. As shown in FIG. 3, a base 18 that is a bottomed cylinder having an opening 58 on the side which is attached to the bottom portion 16*a* of the reflector 16 may be used, and the inside of the base 18 may be the accommodation recess 54.

The steps to produce the light source device 10 according to the present embodiment will briefly be described. First, the outer end portion 24*a* of one of the sealing portions 24 of the high-pressure discharge lamp 12, to which the trigger wire 80 is attached in advance as necessary, is inserted from the inside of the reflector 16 into the insertion hole 44 and exposed to the outside, and then a current-carrying wire 64, which is connected to the external lead rod 32 that protrudes from the other sealing portion 24 opposite to the sealing portion 24 inserted in the insertion hole 44, is inserted into the insertion hole 44. In this state, a heat-resistant adhesive 78 is filled into a gap between the outer surface of the sealing portion 24 and the inner surface of the insertion hole 44 until the gap is completely closed, and thus the high-pressure discharge lamp 12 and the current-carrying wire 64 are fixed to the reflector 16.

Next, the base 18 is attached so as to cover the bottom portion 16*a* of the reflector 16 from the outside, and the external electrode 42 is formed by winding the current-carrying wire 64 passed through the insertion hole 44 around the outer surface of the discharge container 38 of the auxiliary lamp 14 in which the internal electrode 40 is previously embedded. Then, the auxiliary lamp 14 is located along the outer end portion 24*a* of the sealing portion 24 exposed to the outside of the reflector 16 such that the wound current-carrying wire 64 (=the external electrode 42) is in contact with the outer surface of the sealing portion 24.

Subsequently, the internal electrode 40 of the auxiliary lamp 14 is electrically connected to the external lead rod 32 protruding from the sealing portion 24, of the high-pressure discharge lamp 12, that has been inserted in the insertion hole 44. In addition, a current-carrying wire 82 whose one end is connected to the external lead rod 32 is led to the outside through the current-carrying wire insertion hole 66, and then the cover 62 which covers the opening 60 of the base 18 is attached. Finally, another current-carrying wire 84 is electrically connected to the other external lead rod 32 on the opposite side, to complete the light source device 10.

When a predetermined voltage is applied between the current-carrying wires 82 and 84 led to the outside, discharge occurs between the internal electrode 40 and the external electrode 42 in the auxiliary lamp 14. Thus, the discharging medium M2 enclosed in the ultraviolet ray generation space 36 is excited to generate the ultraviolet rays UV.

The generated ultraviolet rays UV enter the sealing portion 24 that is adjacent to the discharge container 38, then pass through the sealing portion 24 into the internal space 20 of the light-emitting portion 22 and strike the main electrodes 28 (at least the cathode in the case of a DC discharge lamp). When the main electrodes 28 are irradiated with the ultraviolet rays UV, emission of electrons from the main electrodes 28 is promoted. Thus, discharge between the main electrodes 28 is caused by a reduced applied voltage, glow discharge and the subsequent arc discharge occur between the main electrodes 28, and light of a predetermined wavelength is emitted from the light-emitting material M1 excited by the discharge.

According to the light source device 10 of the present embodiment, the thickness t of the bottom portion 16*a* of the reflector 16 in which the insertion hole 44 is formed is set to be small such that the entire ultraviolet ray emitting space 36 of the auxiliary lamp 14 located along the side surface of the sealing portion 24 projecting through the insertion hole 44 of the reflector 16 into the accommodation space 52 of the base 18 faces the sealing portion 24 and is accommodated in the accommodation space of the base 18. Therefore, the distance from the auxiliary lamp 14 to the light-emitting portion 22 of the high-pressure discharge lamp 12 can be shortened, and the auxiliary lamp 14 can be prevented from being exposed to the outside without increasing the entire length of the light source device 10. In addition, since the entire ultraviolet ray emitting space 36 faces the sealing portion 24, it is possible to minimize the amount of the ultraviolet rays UV that do not strike the main electrodes 28, thereby maintaining the effect of improving the lighting starting properties. Consequently, a predetermined improvement effect of the lighting starting properties can be obtained.

EXAMPLES

The light source device 10 according to the first embodiment was tested for the lighting performance of the high-pressure discharge lamp 12 by varying the thickness t of the bottom portion 16*a* of the reflector 16. The results are shown in Table 1. Products that have a thickness t greater than 3 mm can be produced by pressing, while products that have a thickness t of 3 mm or less can be produced by machining.

TABLE 1

| Thickness of bottom portion of reflector [mm] | Test result |
|---|---|
| 1 | Non-producible |
| 1.5 | ○ |
| 2 | ○ |
| 3 | ○ |
| 4 | ○ |
| 5 | ○ |
| 5.5 | X |
| 6 | X |

High-pressure discharge lamp: 200 W DC
Starting voltage: 2 kV

As shown in Table 1, it has been found that when the thickness t of the bottom portion 16*a* of the reflector 16 is 5 mm or less, favorable lighting performance can be obtained. In addition, it has been found that the lower limit of the thickness t of the bottom portion 16*a* is 1.5 mm because when the thickness t of the bottom portion 16*a* is 1 mm or less, the thickness t is too small and "chipping" occurs. For the tests shown in Table 1, a 200 W high-pressure discharge lamp 12 for DC was used, and the lighting starting voltage was 2 kV. In addition, five light source devices 10 were prepared as samples for each dimension, and the case where ail the high-pressure discharge lamps 12 were lit at a first attempt to start lighting was evaluated as "○".

Second Embodiment

As shown in FIG. 3, the second embodiment is different from the first embodiment in that the high-pressure discharge lamp 12 and the auxiliary lamp 14 are inserted and fixed in a bottom surface 18*a* of a base 18 that is a bottomed cylinder, and there is a first gap 68 between the inner surface of the insertion hole 44 of the reflector 16 and the outer surface of the sealing portion 24.

A first hole 70 for inserting and fixing the high-pressure discharge lamp 12, and a second hole 72 for inserting and fixing the auxiliary lamp 14 are formed in the bottom surface 18*a* of the base 18. As described above, the high-pressure discharge lamp 12 and the auxiliary lamp 14 are inserted and fixed in the corresponding holes 70 and 72, respectively, with the adhesive 78.

If the light source device 10 is structured in this manner, part of the ultraviolet rays UV emitted from the auxiliary lamp 14 enter the light-emitting portion 22 of the high-pressure discharge lamp 12 through the first gap 68, and strike the main electrodes 28. Accordingly, the ultraviolet rays UV for improving the lighting starting properties of the high-pressure discharge lamp 12 strike the main, electrodes 28 in the light-emitting portion 22 not only via a route passing through the sealing portion 24 of the high-pressure discharge lamp 12 but also via a route entering the light-emitting portion 22 from the outside. Since the amount of the ultraviolet rays UV striking the main electrodes 28 is thus increased, even if the thickness t of the bottom portion 16*a* of the reflector 16 is slightly increased, predetermined lighting starting properties can be obtained.

The light source device 10 according to the second embodiment was tested for the lighting performance of the high-pressure discharge lamp 12 by varying the thickness t of the bottom portion 16*a* of the reflector 16. The results are shown in Table 2.

TABLE 2

| Thickness of bottom portion of reflector [mm] | Test result |
|---|---|
| 1 | Non-producible |
| 1.5 | ○ |
| 2 | ○ |
| 3 | ○ |
| 4 | ○ |
| 5 | ○ |
| 5.5 | ○ |
| 6 | X |

High-pressure discharge lamp: 200 W DC
Starting voltage: 2 kV

As show a in Table 2, it has been found that when the thickness t of the bottom portion 16*a* of the reflector 16 is 5.5 mm or less, favorable lighting performance can be obtained. It can be considered that the reason why the upper limit of the thickness t of the bottom portion 16*a* of the reflector 16 is increased as compared to the test results of the first embodiment is that the amount of the ultraviolet rays UV striking the main electrodes 28 is increased. For the tests shown in Table 2, a 200 W high-pressure discharge lamp 12 for DC was used, and the lighting starting voltage was 2 kV. In addition, five light source devices 10 were prepared as samples for each dimension, and the case where all the high-pressure discharge lamps 12 were lit at a first attempt to start lighting was evaluated as "○".

Third Embodiment

Figure 4:
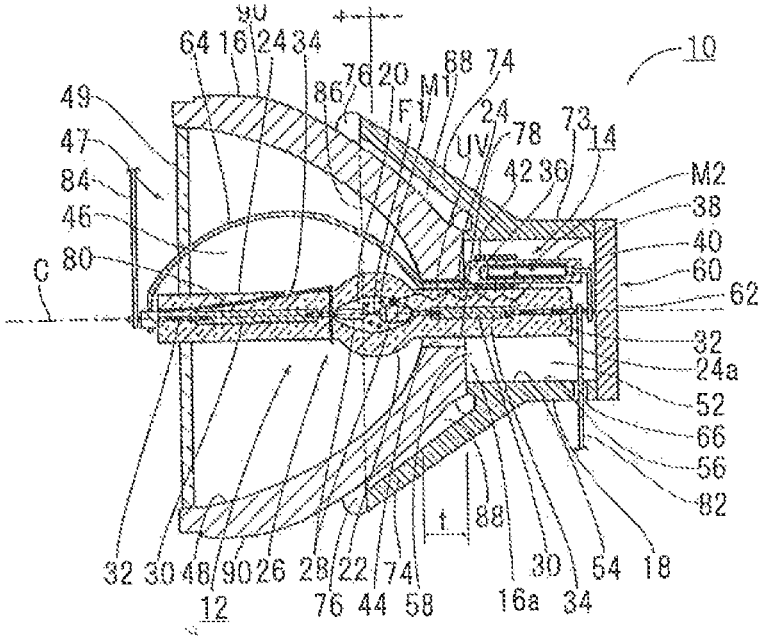
FIG. 4 is a cross-sectional view showing a light source device according to still another embodiment.
Figure 5:
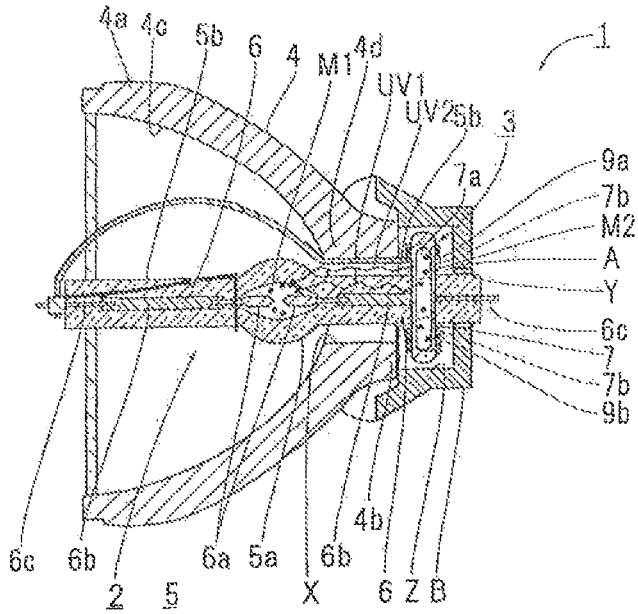
FIG. 5 is a cross-sectional view showing a conventional technique.
Figure 6:
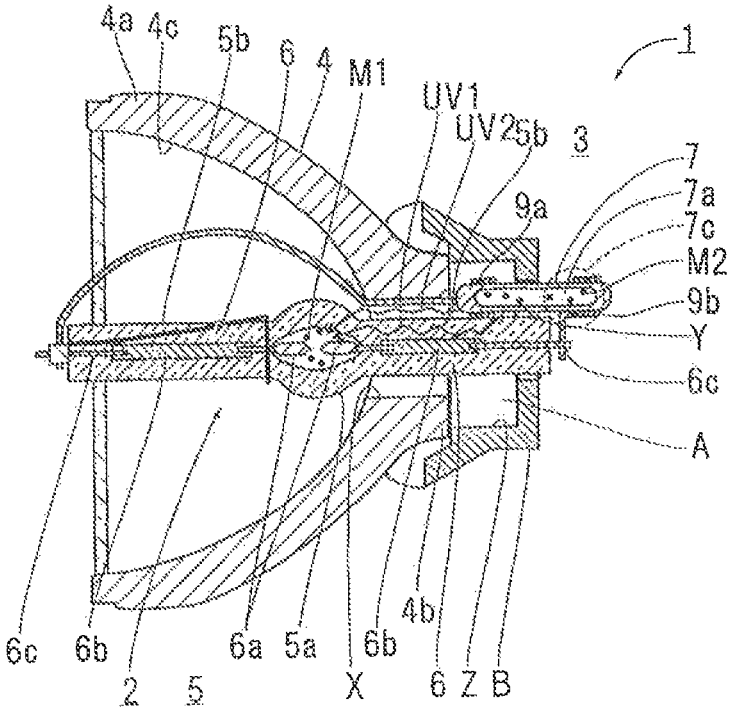
FIG. 6 is a cross-sectional view showing another conventional technique.
Figure 7:
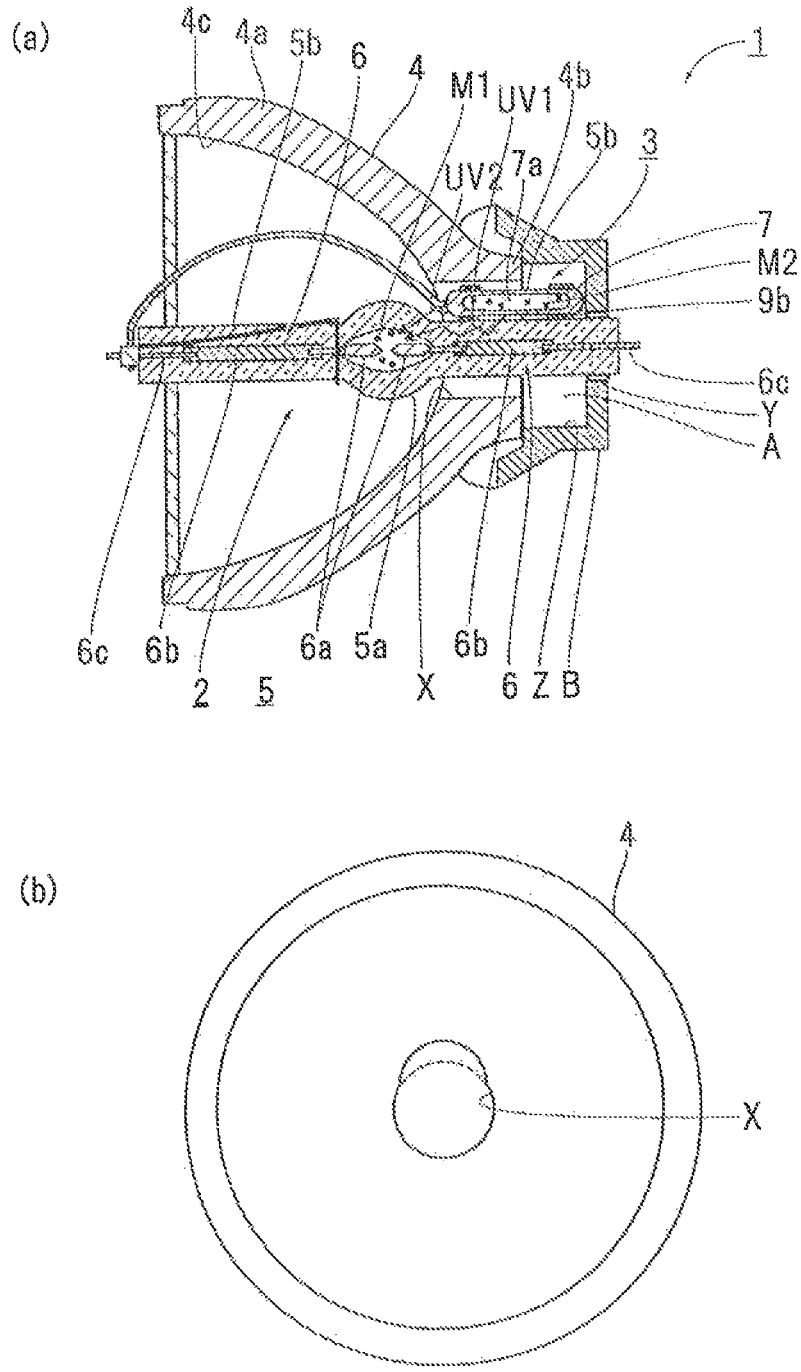
FIG. 7(*a*) is a cross-sectional view showing still another conventional technique, and FIG. 7(*b*) is a view of a reflector as seen from the front (seen from the left in FIG. 7(*a*).

In the third embodiment, as shown in FIG. 4, the base 18 is a bowl-shaped member that includes a main body portion 73 in which the accommodation space 52 is formed and which is attached to the surface of the bottom portion 16*a* of the reflector 16, and a cover portion 74 which extends from the main body portion 73 so as to cover the bottom portion 16*a* of the reflector 16 with a second gap 88 from an outer surface 90 of the reflector 16 and whose front end portion 76 is attached to the outer surface 90. When the base 18 is attached to the bottom portion 16*a* of the reflector 16, the center of the light-emitting portion 22 of the high-pressure discharge lamp 12 accommodated in the reflector 16 is positioned on an opening face 86 of the base 18 which is defined by the periphery of the second gap 88 on the front end portion 76 side, or is positioned inwardly from the opening face 86.

When the light-emitting portion 22 is burst for some reason (e.g., aged deterioration and overcurrent), the part of the reflector 16 on the bottom portion 16*a* side with respect to the center of the light-emitting portion 22 of the high-pressure discharge lamp 12 is likely to be subject to impact by the burst. If the center of the light-emitting portion 22 of the high-pressure discharge lamp 12 is positioned on the opening face 86 defined by the periphery, on the front end portion 76 side, of the second gap 88 between the cover portion 74 and the outer surface 90 of the reflector 16, or is positioned inwardly from the opening face 86, the cover portion 74 of the base 18 is extended over the "impact-susceptible part" of the reflector 16 between the front end portion 76 described above and the part at which the main body portion 73 of the base 18 is attached to the reflector 16. As a result, the second gap 88 can act as a buffer for absorbing a mechanical impact caused by breakage of the light-emitting portion 22.

Accordingly, even if the light-emitting portion 22 is burst and the reflector 16 is cracked, since the second gap 88 absorbs an impact acting on the "impact-susceptible part" of the reflector 16, breakage of the reflector 16 can be avoided.

Although in the third embodiment, the front end portion 76 of the cover portion 74 is formed by an adhesive, the form of the front end portion 76 is not limited thereto. It is also conceivable that the front end portion 76 of the cover portion 74 is bent inward, and fixed to the outer surface 90 of the reflector 16 by an adhesive applied to the end surface of the bonded part.

The light source device 10 according to the third embodiment was tested for the fragility of the reflector 16 by varying the distance between the opening face 86 of the base 18 and the center of the light-emitting portion 22 of the high-pressure discharge lamp 12. The results are shown in Table 3. The center of the light-emitting portion 22 is used as a reference (=zero), and the distance is indicated as a positive (+) for the cases where the position of the opening face 86 of the base 18 was shifted toward the light sending-out opening 47 of the reflector 16, and is indicated as a negative (−) for the cases where the position of the opening face 86 of the base 18 was shifted toward the bottom portion 16*a*.

TABLE 3

| Distance from center of light-emitting portion to opening face of base [mm] | Test result |
|---|---|
| −4 | X |
| −3 | X |
| −2 | X |
| −1 | X |
| 0 | ○ |
| +1 | ○ |
| +2 | ○ |

High-pressure discharge lamp: 200 W DC

As shown in Table 3, it has been found that when the position of the opening face 86 of the base 18 is at the center of the light-emitting portion 22 of the high-pressure discharge lamp 12 (the center of the light-emitting portion 22 coincides with the focal point F1 of the paraboloid of revolution which defines the reflection surface 48 of the reflector 16 in the present embodiment) or is shifted from the center toward the light sending-out opening 47 of the reflector 16 (i.e., positive side), the reflector 16 is only cracked and not broken. For the tests shown in Table 3, a 200 W high-pressure discharge lamp 12 for DC was used, and a high energy current was momentarily applied from a capacitor. Ten light source devices 10 were prepared as samples for each dimension, and the case where all the reflectors 16 were not broken was evaluated as "○".

DESCRIPTION OF THE REFERENCE CHARACTERS

10 light source device
12 high-pressure discharge lamp
14 auxiliary lamp
16 reflector
18 base
20 internal space (of light-emitting portion)
22 light-emitting portion
24 sealing portion
26 light-emitting tube
28 main electrode
30 metal foil
32 external lead rod
34 power feeding means
36 ultraviolet ray generation space
38 discharge container
40 internal electrode
42 external electrode
44 insertion hole
46 inner space
47 light sending-out opening
48 reflection surface
49 front cover
52 accommodation space (of base)
54 accommodation recess
56 through hole
58 opening
60 opening
62 cover
64 current-carrying wire
66 current-carrying wire insertion hole
68 first gap
70 first hole
72 second hole
73 main body portion
74 cover portion
76 peripheral portion
78 adhesive
80 trigger wire
82 current-carrying wire
84 current-carrying wire
86 opening face
88 second gap
90 outer surface (of reflector)

The invention claimed is:

1. A light-emitting device, comprising:

a high-pressure discharge lamp having a light-emitting portion having therein a pair of main electrodes opposed to each other and elongated sealing portions extending outward from the light-emitting portion;

a bowl-shaped reflector having an insertion hole which is formed in a bottom portion and in which one of the sealing portions and a current-carrying wire for an auxiliary lamp are inserted, an inner space in which the high-pressure discharge lamp is accommodated with the one sealing portion inserted in the insertion hole and a reflection surface which is formed on an inner surface of the reflector and which reflects light from the high-pressure discharge lamp;

an auxiliary lamp having an elongated ultraviolet ray emitting space in which ultraviolet rays are generated;

the current-carrying wire which is connected to an external lead rod protruding from the other sealing portion opposite to the sealing portion inserted in the insertion hole, and which is wound around an outer surface of a discharge container of the auxiliary lamp to form an external electrode; and a base attached over an outer surface of the bottom portion of the reflector and having formed therein an accommodation space in which the auxiliary lamp is accommodated between the bottom portion and the base, wherein:

a thickness of the bottom portion of the reflector in which the insertion hole is formed is set such that an outer end portion of the sealing portion inserted in the insertion hole projects through the insertion hole into the accommodation space of the base, and such that the entire elongated ultraviolet ray emitting space of the auxiliary lamp is located along an elongated side surface of the sealing portion, faces the sealing portion, and is accommodated in the accommodation space;

the base is a bowl-shaped member including a main body portion in which the accommodation space is formed and which is attached to a surface of the bottom portion of the reflector, and a cover portion which extends from the main body portion so as to cover the bottom portion of the reflector with a second gap from an outer surface of the reflector and whose front end portion is attached to the outer surface; and when the base is attached to the bottom portion of the reflector, a center of the light-emitting portion of the high-pressure discharge lamp accommodated in the reflector is positioned on an opening face, of the base, which is defined by a periphery of the second gap on the front end portion side, or is positioned inwardly from the opening face.

2. A light-emitting device, comprising:

a high-pressure discharge lamp having a light-emitting portion having therein a pair of main electrodes opposed to each other and elongated sealing portions extending outward from the light-emitting portion;

a bowl shaped reflector having an insertion hole which is formed in a bottom portion and in which one of the sealing portions and a current-carrying wire for an auxiliary lamp are inserted, an inner space in which the high-pressure discharge lamp is accommodated with the one sealing portion inserted in the insertion hole and a reflection surface which is formed on an inner surface of the reflector and which reflects light from the high-pressure discharge lamp;

an auxiliary lamp having an elongated ultraviolet ray emitting space in which ultraviolet rays are generated;

the current-carrying wire which is connected to an external lead rod protruding from the other sealing portion opposite to the sealing portion inserted in the insertion hole, and which is wound from an outer surface of a discharge container of the auxiliary lamp to form an external electrode; and a base attached over an outer surface of the bottom portion of the reflector and having formed therein an accommodation space in which the auxiliary lamp is accommodated between the bottom portion and the base, wherein:

a thickness of the bottom portion of the reflector in which the insertion hole is formed in set such that an outer end portion of the sealing portion inserted in the insertion hole projects through the insertion hole into the accommodation space of the base, and such that the entire elongated ultraviolet ray emitting space of the auxiliary lamp is located along an elongated side surface of the sealing portion, faces the sealing portion, and is accommodated in the accommodation space;

there is a first gap between an inner surface of the insertion hole of the reflector and an outer surface of the sealing portion inserted in the insertion hole;

the base is a bowl-shaped member including a main body portion in which the accommodation space is formed and which is attached to a surface of the bottom portion of the reflector, and a cover portion which extends from the main body portion so as to cover the bottom portion of the reflector with a second gap from an outer surface of the reflector and whose front end portion is attached to the outer surface; and when the base is attached to the bottom portion of the reflector, a center of the light-emitting portion of the high pressure discharge lamp accommodated in the reflector is positioned on an opening face, of the base, which is defined by a periphery of the second gap on the front end portion side, or is positioned inwardly from the opening face.

* * * * *